US006164217A

United States Patent [19]

Prendergast

[11] Patent Number: 6,164,217

[45] Date of Patent: Dec. 26, 2000

[54] FOLDING TABLE

[75] Inventor: Michael Prendergast, Knaresborough, United Kingdom

[73] Assignee: Mad Design Co. Ltd., North Yorkshire, United Kingdom

[21] Appl. No.: 09/308,948

[22] PCT Filed: Aug. 1, 1997

[86] PCT No.: PCT/GB97/02062

§ 371 Date: May 26, 1999

§ 102(e) Date: May 26, 1999

[87] PCT Pub. No.: WO98/24342

PCT Pub. Date: Jun. 11, 1998

[30] Foreign Application Priority Data

Nov. 30, 1996 [GB] United Kingdom ..... 9624984

[51] Int. Cl.[7] ..... A47B 3/00

[52] U.S. Cl. ..... 108/115; 108/124; 248/167

[58] Field of Search ..... 108/115, 124, 108/128; 248/167, 166

[56] References Cited

U.S. PATENT DOCUMENTS

| | | | |
|---|---|---|---|
| 1,668,282 | 5/1928 | Moore et al. | 248/167 |
| 2,860,020 | 11/1958 | Nickliss et al. | 108/124 |
| 3,188,158 | 6/1965 | Sanchez . | |
| 3,561,376 | 2/1971 | Knoblock | 108/124 |
| 3,805,710 | 4/1974 | Leshem | 108/124 X |
| 4,099,469 | 7/1978 | Sahli | 108/115 X |

FOREIGN PATENT DOCUMENTS

| | | | |
|---|---|---|---|
| 0613637 A1 | 11/1993 | European Pat. Off. . | |
| 35067 | 5/1886 | Germany . | |
| 2321750 | 4/1973 | Germany . | |
| 240961 | 6/1946 | Switzerland | 108/115 |

*Primary Examiner*—Janet M. Wilkens
*Attorney, Agent, or Firm*—Head, Johnson and Kachigian

[57] ABSTRACT

A table movable between an erected in-use position and a substantially flatter position for storage. The table includes a table-top and a frame with supporting legs wherein the table is movable between the erected and substantially flattened conditions with the table-top remaining in contact with the frame. The frame includes a part which is in fixed position relative to the table-top. The table also includes two movable members, each having a leg portion. When in the erected condition, a free end is adjacent to a corner of the table. The leg portions are located on portions of the movable members which protrude outwardly from the side of a plane of a fixed portion of the frame.

8 Claims, 4 Drawing Sheets

FOLDING TABLE

CROSS-REFERENCE TO RELATED APPLICATIONS

This application claims priority to PCT No. PCT/GB97/02062 filed Aug. 1, 1997 which claims priority from British Patent Application No. 9624984.2 filed Nov. 30, 1996.

BACKGROUND OF THE INVENTION

The invention which is the subject of this application relates to an item of furniture and particularly to an item of furniture in the form of a desk or table and, yet further, in relation to a desk or table which is required to be movable between an erected position for use and a collapsed, substantially flatter condition, for storage.

At the present time there are known several types of collapsible table, and reference hereinafter to table should be recognized as including a desk or any other similar form of furniture, which can be moved between an erected condition and a storage condition. One conventional and well-known type utilizes a main frame upon which the majority of the table top is based and, depending from said table top, there is provided at least one flap which is movable to a position in line with the table top so as to extend the size of same and is held in that position by a gate wing which is hingedly movable between a storage position and a position to lie under and support the flap in the same plane as the table top. In use, it is known that the gate wing portions can move during use thereby leaving the table top to be insecure and, the flap portions, if leaned on heavily, can lead to the table toppling over due to the fact that only one gate wing is supporting the flap portion. Furthermore, these flap portions are only provided to allow enlargement of the table tops and therefore the table is not truly collapsible to a size suitable for storage. For this reason, gate wing tables are not regarded as being an acceptable design for tables which are required to be stored in a substantially flattened condition as is required, for example, in office environments. Thus, there is a perceived need for collapsible tables and one known solution is to provide a table top with a plurality of location plates, typically provided at the corners of the table top and on the underside thereof, and with which are engagable table legs to provide a table in an erected condition and, when required to be in a storage condition, the table legs are disconnected and stored separately and in a disconnected form from the table top. This can lead to the legs being misplaced and/or the engagement means becoming worn through repeated use.

A further alternative is to provide a frame onto which the table top can be secured or placed and wherein said frame is collapsible to be stored along with the table top. Again however, the frame is required to be disconnected from the table top and stored separately from the table top and, when the tables are of larger size, the frame can become unmanageable and bulky. Thus, both of these known tables have the inconvenience of having separate parts required to be stored and this allows the possibility of table legs or frames being lost or misplaced from the table top. A further significant disadvantage is that the erection of these two types of table to an in-use form requires more than one person and also the table top is required to be moved and held on its side or upside down while the frame or legs are assembled and attached thereto. When a number of tables are required to be erected it can readily be seen that this is time consuming and inconvenient.

The aim of the present invention is to provide a table which is movable between an erected condition for use and a substantially flatter condition for storage and to provide a table in a manner so that the same can be erected by one person and that the various parts of the table are maintained in contact in, and between, both positions. A further aim is that the table is self standing when in a flattened or erected condition.

SUMMARY OF THE INVENTION

In a first aspect of the invention there is provided a table movable between an erected in-use position and a substantially flatter condition for storage, said table comprising a table top and a frame with supporting legs wherein said table is movable between erected and substantially flattened conditions with the table top remaining in contact with the frame.

In one embodiment there is provided a table which is movable between an erected in-use position and a substantially flatter condition for storage, said table comprising a table top hingedly secured to a frame, said frame having at least one member movable in relation thereto from a retracted position to an angled position when the table moves between storage and erected conditions and said table can be moved between storage and erected conditions with the table top in engagement with the frame.

Thus there is provided a table where the entire table top is movable relative to the frame between in-use and storage conditions and yet remains in contact with the frame at all times. Thus when moving the table between conditions no connection or disconnection of parts is required.

In a further feature of the invention, there is provided a table with a table top and a frame having two movable members, each having a leg portion and, when moved to an erected condition, the free end of each of the members lie adjacent to one of the corners of the table top.

Typically the underside of the table top is provided with a securing portion which is located to be engagable with the members when in an erected position and thereby allow the members to be engaged with the table top.

In the storage condition, the members lie adjacent the fixed part of the frame with preferably a portion of the same in line with said frame. In one embodiment, the portion of the members which lie within the length of the table top are in parallel with the frame and the remainder of each of the members is angled outwardly from the fixed part of the frame.

Each member typically has a leg or leg portion formed at the free end thereof which contacts with the surface on which the table is mounted. Typically the fixed part of the frame also has two legs or leg portions which contact with the surface such that when the table is in an erected condition there are a plurality of spaced legs or leg portions contacting the surface and each of the same are spaced and adjacent the corners of the table top thereby providing a stable table. In a storage condition, the portions of the movable members on which the legs are provided protrude outwardly from one side of the plane of the fixed part of the frame and the leg portions on the frame depend outwardly from the other side of the plane of the fixed part of the frame thereby allowing the table to be free standing when in a storage condition and this is a further aspect of the invention.

The plane of the fixed part of the frame is typically the vertical plane in line with the horizontal member of the frame. This horizontal member is typically hingedly connected to the table top at a position adjacent to, but offset from, an edge of the table top.

Typically the movable members are hingedly connected to the frame to be pivotally movable in relation thereto.

It is envisaged that the table can be made of any suitable material such as wood or metal and, while there may be design variations to suit the material used, the concept of the invention is not affected.

In which ever embodiment, it is envisaged that the members and/or frame can be provided with solid panels to act as modesty panels to suit the required use of the table when erected.

In a preferred embodiment, legs or leg portions are provided with wheels or castors to contact with the surface on which the table is mounted thereby allowing the table to be moved to a required location when erected and, as the table is free standing in a storage condition, to be moved to a storage location and when in the required position, brakes can be provided to the table to be held in that position. Thus there is no requirement to lift the table, even when in a storage condition, between locations and this is in contrast to the conventional collapsible tables.

When in a storage position the legs of the table are sufficiently spaced so as to allow the table to be self supported thereby allowing the same to be safely stored and moved with the legs in the storage position.

In a further aspect of the invention there is provided a table which is movable between an erected condition for use and a substantially flatter condition for storage, said table comprising a frame with a fixed portion and at least one member movable in relation thereto and having at least one leg portion thereon, and a table top which is connected to and supported by the frame and wherein said table top lies substantially parallel with the fixed portion of the frame in a storage condition and substantially perpendicular to the fixed part of the frame in use.

In one embodiment two movable members are provided and when in a storage condition, each has a portion which protrudes outwardly from the frame and out with the length of the table top such that subsequent tables of the same form and in a storage condition can be placed into the envelope defined by the frame and movable members, and so on with subsequent tables, thereby allowing minimum space to be taken up by a plurality of said tables when stored.

It will be seen that the present table has many advantages, firstly the ability of same to be moved between erected and storage conditions without the requirement to remove or add any components as the same are connected throughout, secondly, the table is free standing in both erected and storage positions thereby making the same easier to move around an environment in whichever condition, and especially if the leg portions are provided with wheels or castors, thirdly, as the table top is provided in constant engagement with the frame there is less chance of components of the table being mislaid or misplaced, thereby ensuring that the table can be erected when required and, as the table top and portions are constantly engaged, the table can be moved between said erected and storage positions by one person.

Specific embodiments of the invention will now be described with reference to the accompanying drawings, wherein:

DETAILED DESCRIPTION OF THE PREFERRED EMBODIMENT

Figure 1:
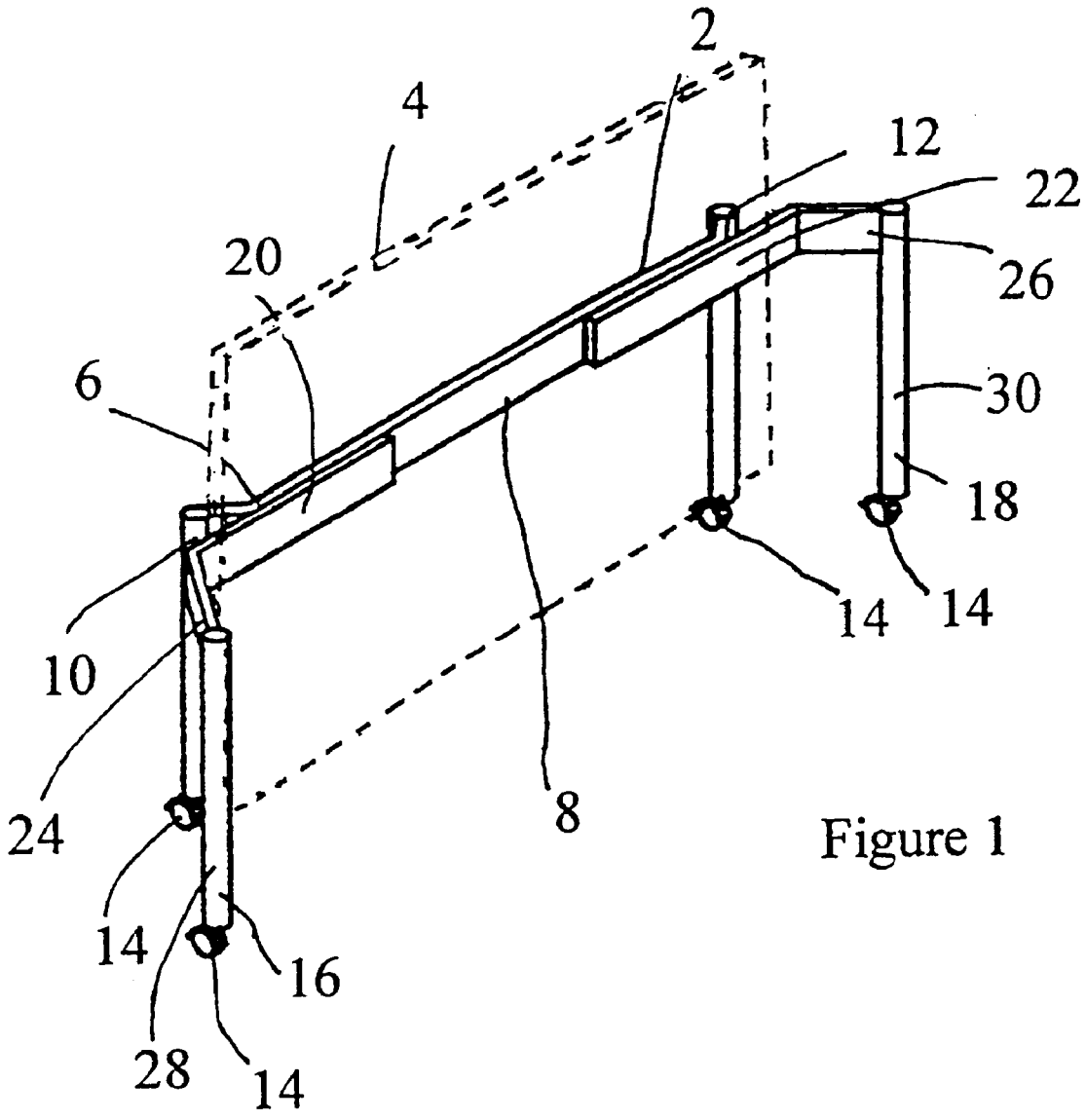
FIG. 1 illustrates the table of the invention in one embodiment in a storage position.

Referring firstly to FIG. 1, there is illustrated a perspective view of the table 2 in a storage position with the table top 4 shown in broken lines. The table top 4 is hingedly connected to a frame 6 which comprises a fixed portion comprising a horizontal member 8 with, at each end and depending away from the horizontal member 8, leg portions 10, 12, and, said leg portions are provided with castors 14. Also hingedly connected to the horizontal member 8, are movable members 16 and 18 which, in the storage position, have portions 20, 22 respectively which lie substantially parallel with the horizontal member 8 and extending portions 24, 26 respectively which are angled to lie outwardly and away from the member 8 and each member terminates at the free end with a leg portion 28, 30 each of which is provided with a castor 14. In this position the table is free standing with the leg portions 10, 12, 28 and 30 acting to support the table in the storage position.

Figure 2:
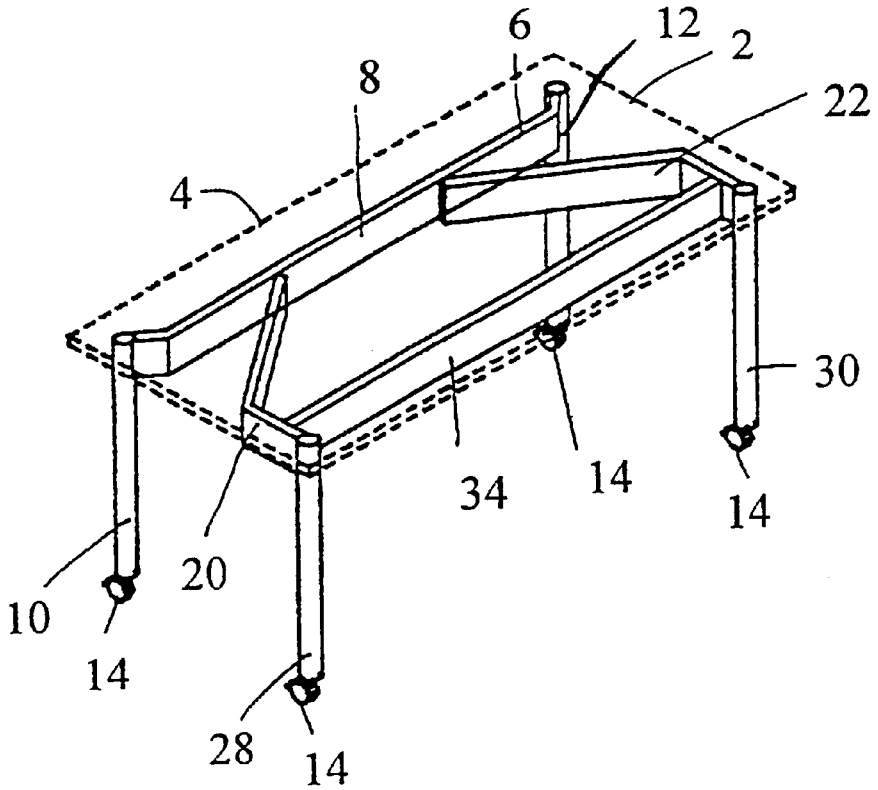
FIG. 2 illustrates a perspective view of the table according to the invention in an erected in-use position.

FIG. 2 illustrates the table 2 in an erected in-use position with the table top 4, shown in broken lines, in a horizontal position and supported by legs 10, 12, 28 and 30 with the legs 28 and 30 moved into a position adjacent the corners of the table top as shown, by moving the members 16, 18 from the storage position to the erected position as shown in FIG. 2. In this embodiment the members are connected with a location member 34 on the underside of the table top thereby securing the members 16, 18 in position and adding rigidity to the table when erected.

Figure 3:
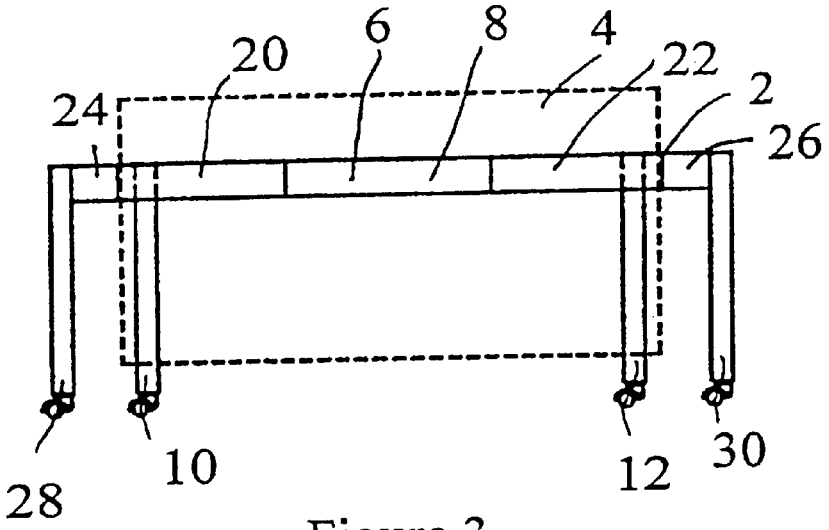
FIG. 3 illustrates an elevation of the table in a storage condition.
Figure 4:
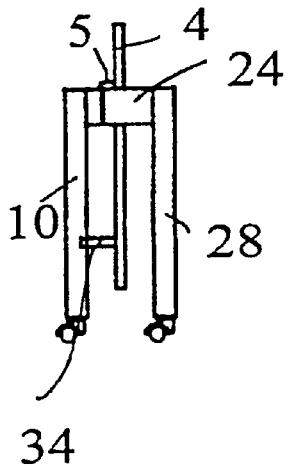
FIG. 4 illustrates an end elevation of the table in a storage condition.
Figure 5:
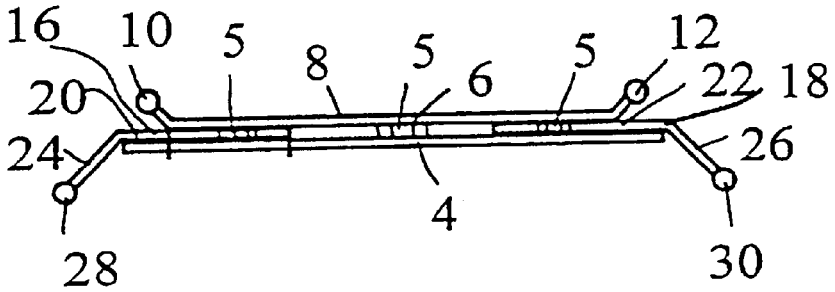
FIG. 5 illustrates a plan view of the table in a storage condition.

Turning now to FIGS. 3, 4 and 5, the table 2 is shown in a storage position in more detail and the arrangement between the various components illustrated. As is seen, the table top 4 is held in a vertical position and the hinges 5 which connect the table top to the frame at horizontal member 8 are of sufficient size to allow the members 16, 18 to lie between the table top 4 and frame 6 when in a storage position and also shown is the fact that the portions 24, 26 of members 16, 18 are angled outwardly, out with the length of the table top 4, so that subsequent tables in a storage condition can be moved into the space envelope defined between the members 16, 18 and table top 4 to allow several of these tables to be stored with a minimum of space required. Also illustrated is the manner in which the legs 10, 12, 28 and 30 are spaced so as to allow the table top to be free standing when in a storage condition.

Figure 6:
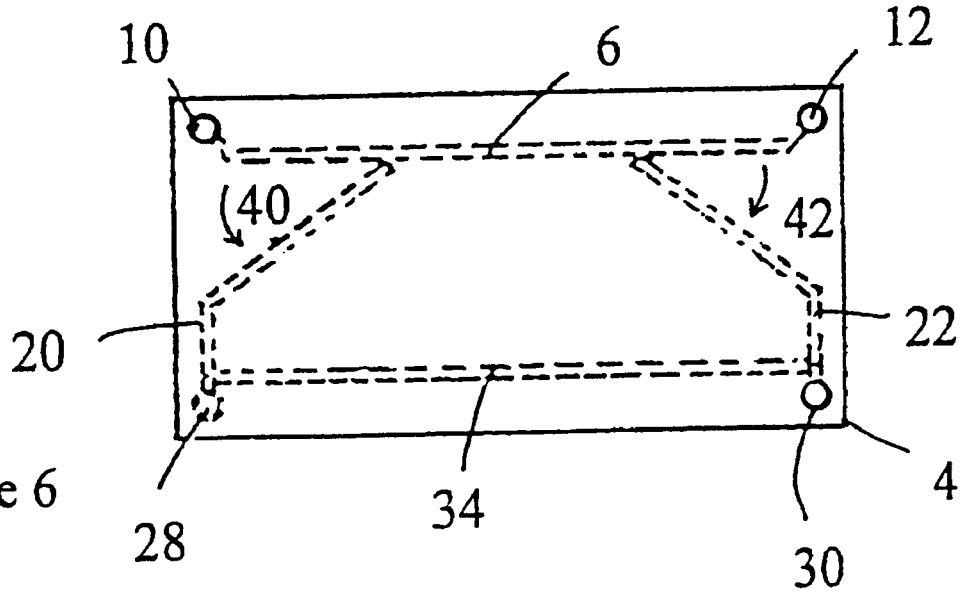
FIG. 6 illustrates a plan view of the table in an erected in-use condition.
Figure 7:
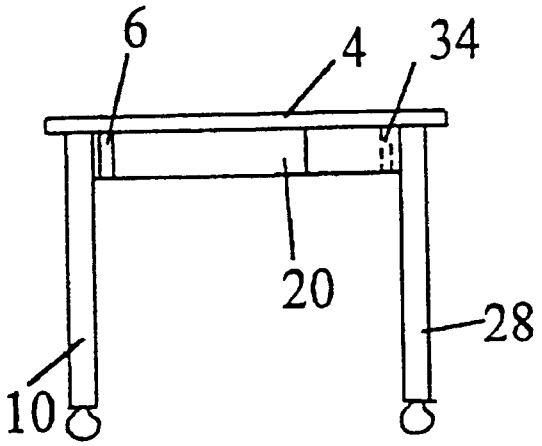
FIG. 7 illustrates a side view of the table in an erected condition.

To move the table between a storage position and an erected position, the table top is moved to a horizontal position as shown in FIGS. 6 and 7 and the members 16, 18 are then free to be moved to the erected position as shown by arrows 40,42 in FIG. 6 whereupon the same can then be connected to the location member 34 by means of locating pins and securing holes. Thus in this position the table is erected.

It will readily be seen that the invention of this application has considerable advantage over the known tables of this type as expressed hereinbefore.

What is claimed is:

1. A table movable between an erected in-use position and a substantially flatter condition for storage, said table comprising:

a table top and a frame with supporting legs wherein said table is movable between said erected in-use position and said substantially flatter condition with the table top remaining in contact with the frame;

said frame including a part which is in fixed position relative to the table top;

two movable members, each having a leg portion, and in said erected position, a free end adjacent to a corner of said table; and said leg portions are located on portions of said movable members which protrude outwardly from a side of a plane of a fixed portion of said frame when in said substantially flatter condition.

2. A table according to claim 1 wherein in said substantially flatter condition for storage, each said movable member lies adjacent the fixed portion of the frame with preferably a portion of the same in line with said fixed part.

3. A table according to claim 1 wherein the portion of each movable member which lies within the length of the table top is in parallel with the fixed portion of the frame, and the remainder of each member is angled outwardly from the fixed portion of the frame when in said substantially flatter condition.

4. A table according to claim 1 wherein the table top is hingedly moveable with respect to the fixed part of the frame to be moved between said erected position wherein the table top lies in a substantially horizontal plane and said substantially flatter condition for storage where the table top lies in a substantially vertical plane.

5. A table according to claim 1 wherein each said leg portion contacts a surface on which the table is mounted and each said supporting leg contacts the surface such that, when the table is in said erected position, there are a plurality of spaced legs or leg portions contacting the surface.

6. A table according to claim 1 wherein said supporting legs or leg portions are spaced and substantially adjacent the corners of the table top when in said erected in-use position.

7. A table according to claim 1 wherein said supporting legs or leg portions of the table are provided with rollers, casters or wheel to ease the movement of the said table.

8. A table according to claim 1 wherein in a storage condition the table is self supported by said leg portions.

* * * * *